US009894747B2

(12) United States Patent
Pärnaste et al.

(10) Patent No.: US 9,894,747 B2
(45) Date of Patent: Feb. 13, 2018

(54) RADIO-FREQUENCY ELECTRODE AND CYCLOTRON CONFIGURED TO REDUCE RADIATION EXPOSURE

(71) Applicant: General Electric Company, Schenectady, NY (US)

(72) Inventors: Martin Pärnaste, Knivsta (SE); Andreas Bäcklund, Uppsala (SE); Lars Walenius, Uppsala (SE)

(73) Assignee: General Electric Company, Schenectady, NY (US)

( * ) Notice: Subject to any disclaimer, the term of this patent is extended or adjusted under 35 U.S.C. 154(b) by 64 days.

(21) Appl. No.: 14/995,772

(22) Filed: Jan. 14, 2016

(65) Prior Publication Data

US 2017/0208676 A1 Jul. 20, 2017

(51) Int. Cl.

| | |
|---|---|
| ***H05H 7/12*** | (2006.01) |
| ***H05H 7/10*** | (2006.01) |
| ***H05H 13/00*** | (2006.01) |
| *H05H 7/02* | (2006.01) |

(52) U.S. Cl.

CPC ..... *H05H 7/10* (2013.01); *H05H 7/12* (2013.01); *H05H 13/005* (2013.01); *H05H 2007/025* (2013.01); *H05H 2007/122* (2013.01)

(58) Field of Classification Search

None

See application file for complete search history.

(56) References Cited

U.S. PATENT DOCUMENTS

| | | | | |
|---|---|---|---|---|
| 3,582,700 | A * | 6/1971 | Hendry | H05H 7/10 313/62 |
| 4,139,777 | A | 2/1979 | Rautenbach | |
| 5,139,731 | A | 8/1992 | Hendry | |
| 7,656,258 | B1 * | 2/2010 | Antaya | H01F 6/00 313/62 |
| 7,786,442 | B2 * | 8/2010 | Norling | H05H 7/00 250/363.03 |
| 8,106,370 | B2 | 1/2012 | Norling et al. | |
| 8,106,570 | B2 | 1/2012 | Norling et al. | |

(Continued)

OTHER PUBLICATIONS

Brandenburg et al.; The RF-System of the Agor-Cyclotron; Kernfysisch Versneller Instituut; 1989; 5 pages.

(Continued)

*Primary Examiner* — Douglas W Owens
*Assistant Examiner* — Srinivas Sathiraju
(74) *Attorney, Agent, or Firm* — Dean D. Small; The Small Patent Law Group, LLC

(57) ABSTRACT

Radio-frequency (RF) electrode for a cyclotron. The RF electrode includes a hollowed dee having first and second surfaces that oppose each other and define a gap therebetween. The hollowed dee is configured to be electrically controlled to direct a beam of charged particles through the gap and along an orbit plane of the cyclotron. The orbit plane extends parallel to the first and second surfaces through the gap. The RF electrode also includes a bridge structure that is coupled to and extends away from the hollowed dee. The bridge structure includes a side wall that defines an interior cavity of the bridge structure. The side wall has a particle opening therethrough that coincides with or is proximate to the orbit plane such that the particle opening receives neutral particles from an orbit of the charged particles.

20 Claims, 8 Drawing Sheets

(56) References Cited

U.S. PATENT DOCUMENTS 8,324,841 B2 12/2012 Kleeven et al.
8,374,306 B2 2/2013 Norling et al.
8,653,762 B2 * 2/2014 Eriksson ..... H05H 7/00 29/592.1
2006/0164026 A1 * 7/2006 Sasaki ..... H05H 13/00 315/502
2008/0258653 A1 * 10/2008 Nutt ..... H05H 13/00 315/502
2010/0282979 A1 * 11/2010 Norling ..... H05H 7/00 250/396 ML
2012/0161671 A1 * 6/2012 Eriksson ..... H05H 7/00 315/501
2012/0217903 A1 * 8/2012 Tanaka ..... H05H 7/12 315/502
2013/0009571 A1 * 1/2013 Antaya ..... H05H 13/005 315/502
2013/0106315 A1 * 5/2013 Abs ..... H05H 7/02 315/502
2013/0141019 A1 6/2013 Kleeven
2014/0087953 A1 * 3/2014 Bromberg ..... H05H 7/00 505/200
2014/0091734 A1 * 4/2014 Gall ..... A61N 5/1065 315/502
2015/0174429 A1 * 6/2015 Zwart ..... A61N 5/1043 250/396 R
2016/0181996 A1 * 6/2016 Baecklund ..... H01G 4/002 330/44

OTHER PUBLICATIONS

Strijckmans; The isochronous cyclotron: principles and recent developments; Institute for Nuclear Sciences; 2001; 10 pages.
Hartwig; The AEG compact cyclotron; Proceedings of the Fifth International Cyclotron Conference; 1969; 9 pages.
Papash et al.; Commercial Cyclotrons. Part I: Commercial Cyclotrons in the Energy Range 10-30 MeV for Isotope Production; Physics of Particles and Nuclei; vol. 39, No. 4; 2008; 35 pages.
International Search Report and Written Opinion for corresponding PCT application PCT/US2016/047326 dated Nov. 24, 2016; 11 pages.

* cited by examiner

RADIO-FREQUENCY ELECTRODE AND CYCLOTRON CONFIGURED TO REDUCE RADIATION EXPOSURE

BACKGROUND

The subject matter herein relates generally to isotope production systems and, more specifically, to components that have neutral particles incident thereon within an acceleration chamber of the isotope production system.

Radioisotopes (also called radionuclides) have several applications in medical therapy, imaging, and research, as well as other applications that are not medically related. Systems that produce radioisotopes typically include a particle accelerator, such as a cyclotron, that accelerates a beam of charged particles (e.g., H-ions) and directs the beam into a target material to generate the isotopes. The cyclotron includes an ion source that provides negative ions into an acceleration chamber of the cyclotron. The cyclotron uses electrical and magnetic fields to accelerate and guide the negative ions along a predetermined orbit within the acceleration chamber. The magnetic fields are provided by electromagnets and a magnet yoke that surrounds the acceleration chamber. The electrical fields are generated by a pair of radio frequency (RF) electrodes (or dees) that are located within the acceleration chamber. The RF electrodes are electrically coupled to an RF power generator that energizes the RF electrodes to provide the electrical field. The electrical and magnetic fields cause the negative ions to take a spiral-like orbit that has an increasing radius. When the negative ions reach an outer portion of the orbit, the negative ions are stripped of their electrons and form a particle beam that is directed toward the target material for isotope production.

As the negative ions are guided along the orbit, however, a portion of the negative ions may collide with other particles, such as residual gas molecules from the ion source. A negative ion may become a neutral particle upon colliding with the other particle. The neutral particle has a trajectory that is essentially tangent to the point in the orbit at which the negative ion collided with the other particle. The neutral particle then collides with other surfaces in the acceleration chamber, such as the RF electrodes. RF electrodes often comprise copper (or other conductive material). When a proton or a neutral hydrogen collides with copper, a relatively large amount of gamma and neutron radiation is generated and long-lived isotopes (e.g., Zn-65) may be generated. This is often the primary source of radiation within an acceleration chamber. Due to the geometry of the cyclotron in the acceleration chamber, the RF electrodes are particularly exposed to the neutral particles.

The accumulation of induced by-products from unwanted irradiation is a hazard to individuals. When service personnel open the acceleration chamber, the personnel are exposed to the activated parts. Moreover, the health risk created by the prompt radiation is often addressed by increasing the amount of shielding that surrounds the acceleration chamber. This can increase the cost of the cyclotron and require a larger space.

BRIEF DESCRIPTION

In an embodiment, a radio-frequency (RF) electrode for a cyclotron is provided. The RF electrode includes a hollowed dee having first and second surfaces that oppose each other and define a gap therebetween. The hollowed dee is configured to be electrically controlled to direct a beam of charged particles through the gap and along an orbit plane of the cyclotron. The orbit plane extends parallel to the first and second surfaces through the gap. The RF electrode also includes a bridge structure that is coupled to and extends away from the hollowed dee. The bridge structure includes a side wall that defines an interior cavity of the bridge structure. The side wall has a particle opening therethrough that coincides with or is proximate to the orbit plane such that the particle opening receives neutral particles from an orbit of the charged particles.

In an embodiment, a cyclotron is provided that includes an electrical field system and a magnetic field system configured to direct charged particles along an orbit plane within an acceleration chamber. The magnetic field system includes a pair of pole tops that oppose each other across a central region of the acceleration chamber. The orbit plane extends between and generally parallel to the pole tops. The electrical field system includes a plurality of RF electrodes having hollowed dees that are positioned between the pole tops. At least one of the RF electrodes includes a bridge structure that is coupled to and extends away from the corresponding hollowed dee. The bridge structure includes a side wall that defines an interior cavity of the bridge structure. The side wall has a particle opening therethrough that coincides with or is proximate to the orbit plane. The particle opening is located to receive neutral particles generated within the acceleration chamber that project through the particle opening along the orbit plane. The cyclotron also includes an interception panel that is positioned to receive the neutral particles that project through the particle opening along the orbit plane.

In an embodiment, a method is provided that includes providing an RF electrode that has a hollowed dee having first and second surfaces that oppose each other and define a gap therebetween. The RF electrode also includes a bridge structure that is coupled to and extends away from the hollowed dee. The bridge structure includes a side wall that defines an interior cavity of the bridge structure. The side wall has a particle opening therethrough. The method also includes positioning the RF electrode within an acceleration chamber of a cyclotron. The cyclotron is configured to direct charged particles along an orbit plane within the acceleration chamber. The RF electrode is positioned such that the orbit plane extends between the first and second surfaces and extends through or proximate to the particle opening of the side wall. The particle opening is configured to receive neutral particles that project along the orbit plane during operation of the cyclotron. The method also includes positioning an interception panel within the acceleration chamber to receive the neutral particles that project through the particle opening along the orbit plane.

DETAILED DESCRIPTION

Figure 1:
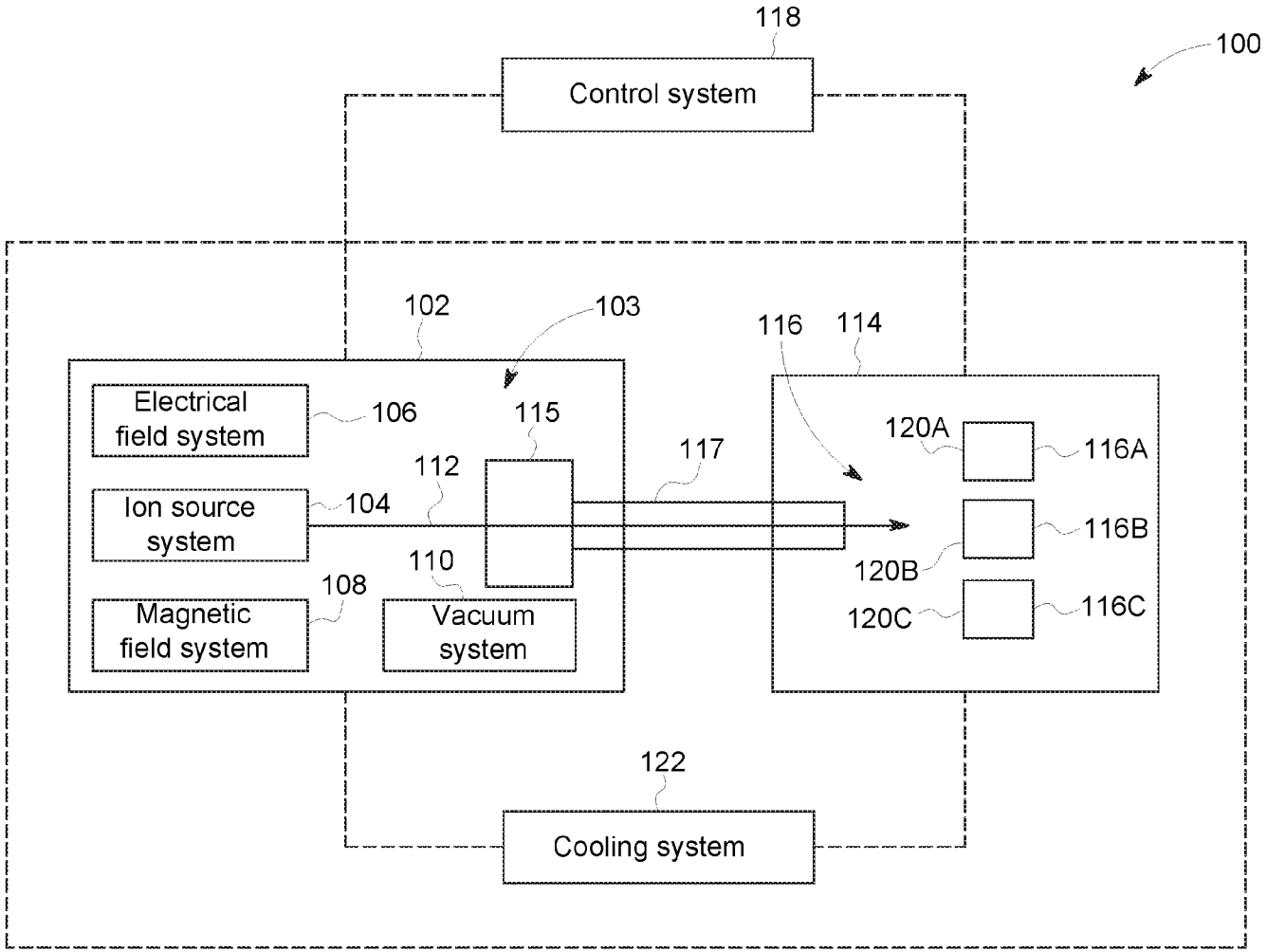
FIG. 1 is a block diagram of a cyclotron in accordance with one embodiment.

The following detailed description of certain embodiments will be better understood when read in conjunction with the appended drawings. To the extent that the figures illustrate diagrams of the functional blocks of various embodiments, the functional blocks are not necessarily indicative of the division between hardware circuitry. For example, one or more of the functional blocks (e.g., processors, memories) may be implemented in a single piece of hardware (e.g., a general purpose signal processor or a block of random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

A technical effect of one or more embodiments may be that individuals working with or near a cyclotron will be less exposed to radiation and/or harmful by-products. For example, an individual may be able to work a greater amount of time in or around the cyclotron before reaching his or her maximum yearly dose limit. Service personnel may be able to install more systems and/or repair more systems before reaching his or her maximum yearly dose limit. Another technical effect of one or more embodiments may include a smaller and/or more efficient radiation shield. As such, the cyclotrons may be constructed smaller than other known cyclotrons.

FIG. 1 is a block diagram of an isotope production system 100 formed in accordance with one embodiment. The system 100 includes a cyclotron 102 that has several subsystems including an ion source system 104, an electrical field system 106, a magnetic field system 108, and a vacuum system 110. The cyclotron 102 may be, for example, an isochronous cyclotron. The cyclotron 102 may include an acceleration chamber 103. The acceleration chamber 103 may be defined by a housing or other portions of the cyclotron and have an evacuated state or condition during operation. The cyclotron 102 shown in FIG. 1 has at least portions of the sub-systems 104, 106, 108, and 110 located in the acceleration chamber 103.

During operation of the cyclotron 102, charged particles are placed within or injected into the acceleration chamber 103 through the ion source system 104. For example, the ion source system 104 may include a grounded ion source tube (not shown) positioned between two cathodes (not shown) that are negatively biased. Hydrogen ($H_2$) gas may be flowed through the ion source tube. A voltage difference between the cathodes and the ion source tube may cause a plasma discharge in the hydrogen gas, thereby generating positive hydrogen ions (protons) and negative hydrogen ions (H−). The negative hydrogen ions may then be extracted from the ion source tube and provided into the acceleration chamber 103. Although the foregoing describes one example of an ion source system, it should be understood that other methods and configurations may be used to provide charged particles to the acceleration chamber 103.

The magnetic field system 108 and the electrical field system 106 are configured to generate respective fields that cooperate in producing a particle beam 112 of the charged particles. The charged particles are accelerated and guided within the acceleration chamber 103 along a predetermined or desired path. The predetermined path may be referred to herein as an orbit and occurs generally along an orbit plane. As described herein, the charged particles may collide with other particles in the acceleration chamber, such as residual gas molecules. These collisions may create neutral particles that are not controlled by the electrical field system 106. The neutral particles exit the orbit and typically collide with other material within the acceleration chamber.

During operation of the cyclotron 102, the acceleration chamber 103 may be in a vacuum (or evacuated) state and experience a large magnetic flux. For example, an average magnetic field strength between pole tops in the acceleration chamber 103 may be at least 1 Tesla. After the particle beam 112 is generated, the pressure of the acceleration chamber 103 may be approximately $2\times10^{-5}$ millibar. However, the above values are only examples and various embodiments may operate within different parameters.

Also shown in FIG. 1, the system 100 has an extraction system 115 and a target system 114 that includes a target material 116. In the illustrated embodiment, the target system 114 is positioned adjacent to the cyclotron 102. To generate isotopes, the particle beam 112 is directed by the cyclotron 102 through the extraction system 115 along a beam transport path or beam passage 117 and into the target system 114 so that the particle beam 112 is incident upon the target material 116 located at a corresponding target location 120. When the target material 116 is irradiated with the particle beam 112, radiation from neutrons and gamma rays may be generated. In alternative embodiments, the system 100 may have a target system located within or directly attached to the accelerator chamber 103.

The system 100 may have multiple target locations 120A-C where separate target materials 116A-C are located. A shifting device or system (not shown) may be used to shift the target locations 120A-C with respect to the particle beam 112 so that the particle beam 112 is incident upon a different target material 116. A vacuum may be maintained during the shifting process as well. Alternatively, the cyclotron 102 and the extraction system 115 may not direct the particle beam 112 along only one path, but may direct the particle beam 112 along a unique path for each different target location 120A-C. Furthermore, the beam passage 117 may be substantially linear from the cyclotron 102 to the target location 120 or, alternatively, the beam passage 117 may curve or turn at one or more points therealong. For example, magnets positioned alongside the beam passage 117 may be configured to redirect the particle beam 112 along a different path.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, the system 100 may generate protons to make $^{18}F^-$ isotopes in liquid form, $^{11}C$ isotopes as $CO_2$, and $^{13}N$ isotopes as $NH_3$. The target material 116 used to make these isotopes may be enriched $^{18}O$ water, natural $^{14}N_2$ gas, $^{16}O$-water. The system 100 may also generate protons or deuterons in order to produce $^{15}O$ gases (oxygen, carbon dioxide, and carbon monoxide) and $^{15}O$ labeled water.

In particular embodiments, the system 100 uses $^1H^-$ technology that brings the charged particles to a designated energy and creates a designated beam current. For example, the system 100 may bring the charged particles to a low energy (e.g., about 9.6 MeV) with a beam current of approximately 10-30 μA. The negative hydrogen ions may be accelerated and guided through the cyclotron 102 and into the extraction system 115. The negative hydrogen ions may then hit a stripping foil (not shown) of the extraction system 115 thereby removing the pair of electrons and making the particle a positive ion, $^1H^+$. It is contemplated that other embodiments may use deuterium or helium.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the cyclotron 102 and the target system 114. Although not shown in FIG. 1, the system 100 may also include one or more radiation and/or magnetic shields for the cyclotron 102 and the target system 114.

The system 100 may also be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 7.8 MeV or less. However, embodiments describe herein may also have an energy above 18 MeV. For example, embodiments may have an energy above 100 MeV, 500 MeV or more.

Figure 2:
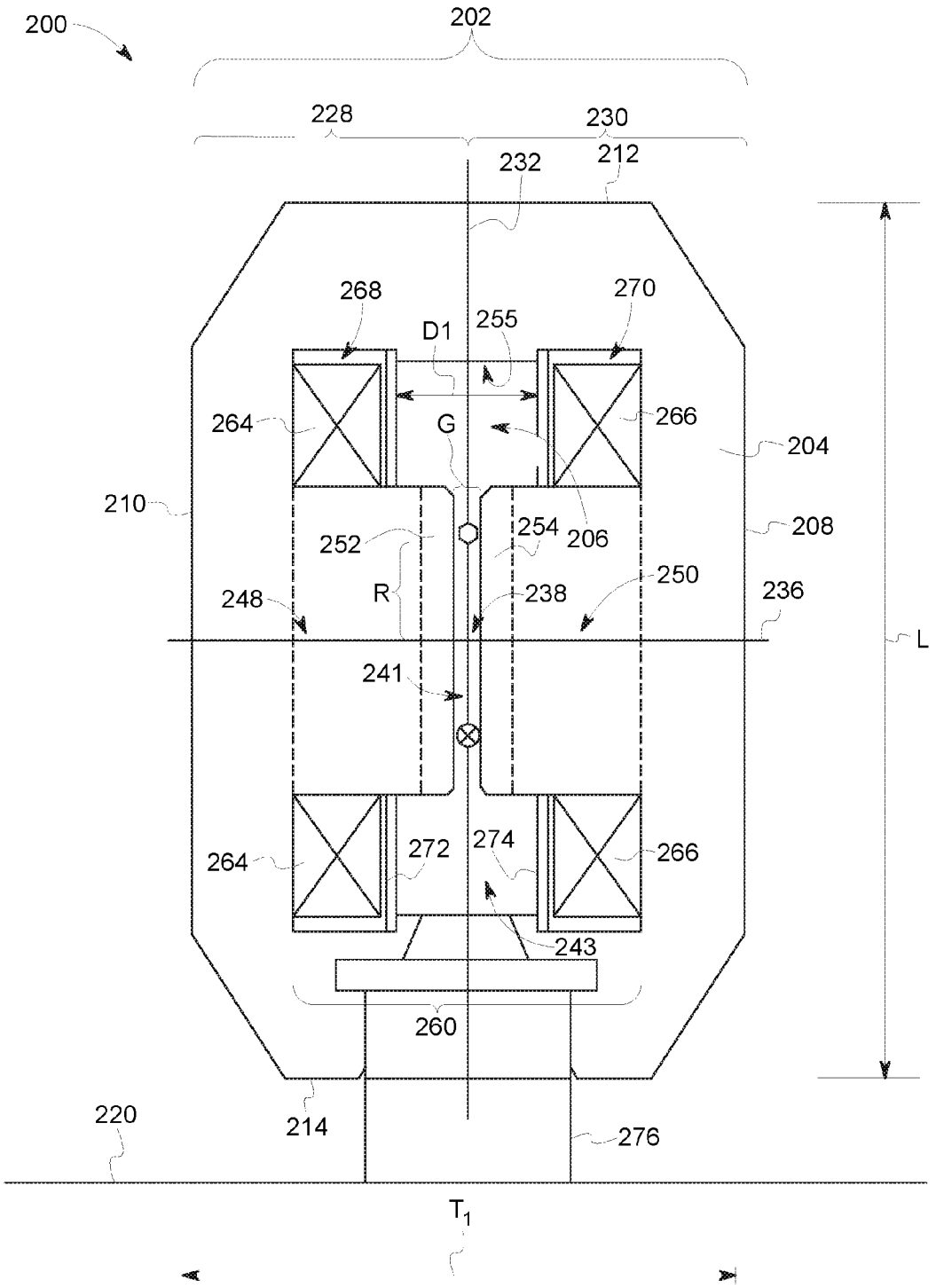
FIG. 2 is a schematic side view of a cyclotron in accordance with one embodiment.

FIG. 2 is a side view of a cyclotron 200 formed in accordance with one embodiment. Although the following description is with respect to the cyclotron 200, it is understood that embodiments may include other cyclotrons and methods involving the same. As shown in FIG. 2, the cyclotron 200 includes a magnet yoke 202 having a yoke body 204 that surrounds an acceleration chamber 206. In alternative embodiments, the acceleration chamber may be surrounded or defined by components other than a magnet yoke, such as a housing or shield. The yoke body 204 has opposite side faces 208 and 210 with a thickness $T_1$ extending therebetween and also has top and bottom ends 212 and 214 with a length L extending therebetween. In the exemplary embodiment, the yoke body 204 has a substantially circular cross-section and, as such, the length L may represent a diameter of the yoke body 204. The yoke body 204 may be manufactured from iron and be sized and shaped to produce a desired magnetic field when the cyclotron 200 is in operation. The yoke body 204 may also be sized and shaped to shield prompt radiation generated within the yoke body 204.

The yoke body 204 may have opposing yoke sections 228 and 230 that define the acceleration chamber 206 therebetween. The yoke sections 228 and 230 are configured to be positioned adjacent to one another along a mid-plane 232 of the magnet yoke 202. The charged particles are configured to move along the mid-plane 232 in a predetermined orbit. Accordingly, the mid-plane 232 is hereinafter referred to as an orbit plane 232.

As shown, the cyclotron 200 may be oriented vertically (with respect to gravity) such that the orbit plane 232 extends perpendicular to a horizontal platform 220 supporting the weight of the cyclotron 200. The cyclotron 200 has a central axis 236 that extends horizontally between and through the yoke sections 228 and 230 (and corresponding side faces 210 and 208, respectively). The central axis 236 extends perpendicular to the orbit plane 232 through a center of the yoke body 204. The acceleration chamber 206 has a central region 238 located at an intersection of the orbit plane 232 and the central axis 236. In some embodiments, the central region 238 is at a geometric center of the acceleration chamber 206.

The yoke sections 228 and 230 include poles 248 and 250, respectively, that oppose each other across the orbit plane 232 within the acceleration chamber 206. The poles 248 and 250 may be separated from each other by a pole gap G. The pole 248 includes a pole top 252 and the pole 250 includes a pole top 254 that opposes the pole top 252. The poles 248 and 250 and the pole gap G therebetween are sized and shaped to produce a desired magnetic field when the cyclotron 200 is in operation. In some embodiments, the poles 248 and 250 include hills and valleys such that the pole gap G varies.

The cyclotron 200 also includes a magnet assembly 260 located within or proximate to the acceleration chamber 206. The magnet assembly 260 is configured to facilitate producing the magnetic field with the poles 248 and 250 to direct charged particles along a desired beam path. The magnet assembly 260 includes an opposing pair of magnet coils 264 and 266 that are spaced apart from each other across the orbit plane 232 at a distance $D_1$. The magnet coils may be substantially circular and extend about the central axis 236. The yoke sections 228 and 230 may form magnet coil cavities 268 and 270, respectively, that are sized and shaped to receive the corresponding magnet coils 264 and 266, respectively. Also shown in FIG. 2, the cyclotron 200 may include chamber walls 272 and 274 that separate the magnet coils 264 and 266 from the acceleration chamber 206 and facilitate holding the magnet coils 264 and 266 in position.

The acceleration chamber 206 is configured to allow charged particles, such as $^1H^-$ ions, to be accelerated therein along a predetermined orbit. The orbit wraps in a spiral manner about the central axis 236 and remains generally along the orbit plane 232. The charged particles are initially positioned proximate to the central region 238. When the cyclotron 200 is activated, the orbit of the charged particles spirals around the central axis 236. In the illustrated embodiment, the cyclotron 200 is an isochronous cyclotron and, as such, the orbit of the charged particles has portions that curve about the central axis 236 and portions that are more linear. However, embodiments described herein are not limited to isochronous cyclotrons, but also includes other types of cyclotrons and particle accelerators. As shown in FIG. 2, when the charged particles orbit around the central axis 236, the charged particles may project out of the page of the acceleration chamber 206 and extend into the page of the acceleration chamber 206. As the charged particles orbit around the central axis 236, a radius R that extends between the orbit of the charged particles and the central region 238 increases. When the charged particles reach a predetermined location along the orbit, the charged particles are directed into or through an extraction system (not shown) and out of the cyclotron 200. For example, the charged particles may be stripped of their electrons by a foil.

The acceleration chamber 206 may be in an evacuated state before and during the forming of the particle beam 112. For example, before the particle beam is created, a pressure of the acceleration chamber 206 may be approximately $1\times10^{-7}$ millibars. When the particle beam is activated and $H_2$ gas is flowing through an ion source (not shown) located at the central region 238, the pressure of the acceleration chamber 206 may be approximately $2\times10^{-5}$ millibar. As such, the cyclotron 200 may include a vacuum pump 276 that may be proximate to the orbit plane 232. The vacuum pump 276 may include a portion that projects radially outward from the end 214 of the yoke body 204.

In some embodiments, the yoke sections 228 and 230 may be moveable toward and away from each other so that the acceleration chamber 206 may be accessed (e.g., for repair or maintenance). For example, the yoke sections 228 and 230 may be joined by a hinge (not shown) that extends alongside the yoke sections 228 and 230. Either or both of the yoke sections 228 and 230 may be opened by pivoting the corresponding yoke section(s) about an axis of the hinge. As another example, the yoke sections 228 and 230 may be separated from each other by laterally moving one of the yoke sections linearly away from the other. However, in alternative embodiments, the yoke sections 228 and 230 may be integrally formed or remain sealed together when the acceleration chamber 206 is accessed (e.g., through a hole or opening of the magnet yoke 202 that leads into the acceleration chamber 206). In alternative embodiments, the yoke body 204 may have sections that are not evenly divided and/or may include more than two sections.

The acceleration chamber 206 may include passages that lead radially outward away from the outer spatial region 243, such as a passage that extends through the yoke body 204 to a target system or a passage for cables. The acceleration chamber 206 may also have a shape that extends along and is substantially symmetrical about the orbit plane 232. For instance, the acceleration chamber 206 may be substantially disc-shaped and include an inner spatial region 241 defined between the pole tops 252 and 254 and an outer spatial region 243 defined between the chamber walls 272 and 274. As used herein, an element may "define" a space without the element entirely defining or enclosing the space. For example, the pole top 252 only defines one boundary of the inner spatial region 241, and the pole top 254 defines an opposite boundary of the inner spatial region 241. The inner spatial region 241 has an undefined boundary and opens to the outer spatial region 243. The inner spatial region 241 represents the space at which the pole tops 252, 254 directly face each other. The inner spatial region 241 includes the orbit of charged particles.

The poles 248 and 250 (or, more specifically, the pole tops 252 and 254) are separated by the inner spatial region 241 where the charged particles are directed along the designated orbit. The magnet coils 264 and 266 may be separated by the outer spatial region 243. In particular, the chamber walls 272 and 274 may have the spatial region 243 therebetween. Furthermore, a periphery of the spatial region 243 may be defined by a wall surface 255 that also defines a periphery of the acceleration chamber 206. The wall surface 255 may extend circumferentially about the central axis 236. As shown, the inner spatial region 241 extends a distance equal to a pole gap G along the central axis 236, and the outer spatial region 243 extends the distance $D_1$ along the central axis 236.

As shown in FIG. 2, the outer spatial region 243 surrounds the inner spatial region 241 about the central axis 236. The inner and outer spatial regions 241 and 243 may collectively form the acceleration chamber 206. Accordingly, in the illustrated embodiment, the cyclotron 200 does not include a separate tank or wall that only surrounds the spatial region 241 thereby defining the spatial region 241 as the acceleration chamber of the cyclotron. The vacuum pump 276 may be fluidly coupled to the spatial region 241 through the spatial region 243. Gas entering the spatial region 241 may be evacuated from the spatial region 241 through the spatial region 243. In the illustrated embodiment, the vacuum pump 276 is fluidly coupled to and located adjacent to the spatial region 243. In addition, an RF electrode (not shown), such as RF electrodes 416, 418 (shown in FIG. 4), may have bridge structures that extend through the outer spatial region 243 to locate hollowed dees within the inner spatial region 241. The RF electrodes may be directly or indirectly coupled to the magnet yoke 202. In particular embodiments, the RF electrodes extend radially inward from the wall surface 255.

Figure 3:
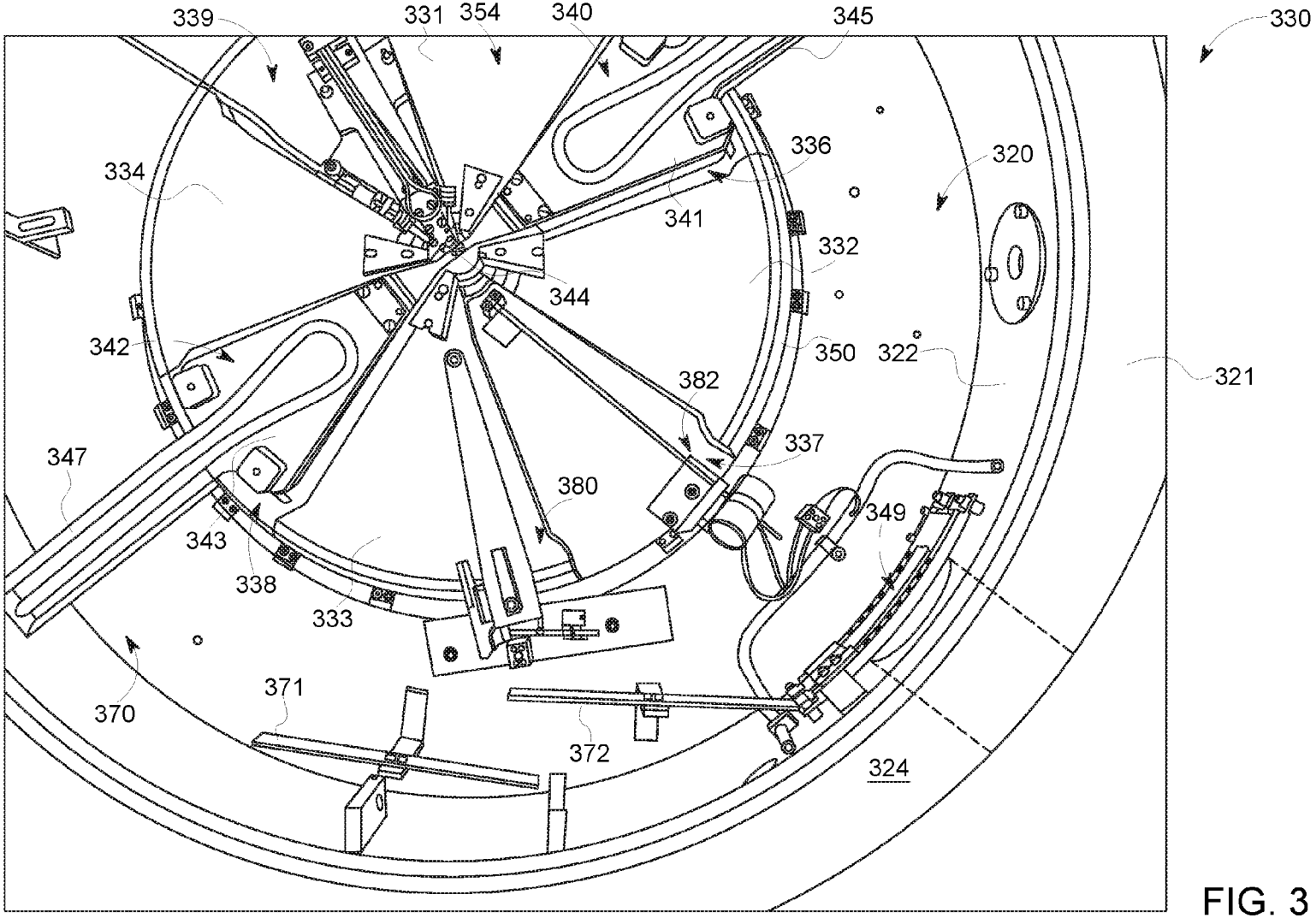
FIG. 3 is a perspective view of a portion of a yoke and pole section that may be used with a cyclotron in accordance with one embodiment.

FIG. 3 is a partial perspective view of a yoke section 330 formed in accordance with one embodiment. The yoke section 330 may oppose another yoke section (not shown). When the opposing yoke section and the yoke section 330 are sealed together, an acceleration chamber may be formed therebetween. When sealed, the two yoke sections may constitute the magnet yoke of a cyclotron, such as the magnet yoke 202 of the cyclotron 200 described above. The yoke section 330 may have similar components and features as described with respect to the yoke sections 228 and 230 (FIG. 2).

As shown, the yoke section 330 includes a ring portion 321 that defines an open-sided cavity 320 having a magnet pole 350 located therein. The open-sided cavity 320 may include portions of inner and outer spatial regions (not shown) of the acceleration chamber, such as the inner and outer spatial regions 241 and 243 discussed above. The ring portion 321 may include a mating surface 324 that is configured to engage a mating surface of the opposing yoke section during operation of the cyclotron. The yoke section 330 includes a yoke or beam passage 349. As indicated by dashed lines, the beam passage 349 extends through the ring portion 321 and provides a path for a particle beam of stripped particles to exit the acceleration chamber.

In some embodiments, a pole top 354 of the pole 350 may include hills 331-334 and valleys 336-339. The hills 331-334 and valleys 336-339 may facilitate directing the charged particles by varying the magnetic field experienced by the charged particles. The yoke section 330 may also include radio frequency (RF) electrodes 340 and 342 that extend radially inward toward each other and toward a center 344 of the pole 350 (or acceleration chamber). The RF electrodes 340 and 342 may include hollowed dees 341 and 343, respectively, that extend from bridge structures 345 and 347, respectively. The hollowed dees 341 and 343 are located within the valleys 336 and 338, respectively. The bridge structures 345 and 347 may be coupled to an interior wall surface 322 of the ring portion 321. The bridge structures 345, 347 extend through an outer spatial region of the acceleration chamber when the yoke section 330 and the opposing yoke section are closed.

Also shown, the yoke section 330 may include interception panels 371 and 372 arranged about the pole 350. The interception panels 371 and 372 are positioned to intercept lost particles within the acceleration chamber. The interception panels 371 and 372 may comprise aluminum or other material, such as graphite or tungsten. Although only two interception panels 371 and 372 are shown in FIG. 3, embodiments described herein may include additional interception panels. For example, interception panels may be disposed relative to or within the bridge structures 345, 347 as described below.

The RF electrodes 340 and 342 may form at least a portion of an RF electrode system 370, such as the electrical field system 106 described with reference to FIG. 1, in which the RF electrodes 340 and 342 accelerate the charged particles within the acceleration chamber. The RF electrodes 340 and 342 cooperate with each other and form a resonant system that includes inductive and capacitive elements tuned to a predetermined frequency of, for example, at least 30 MHz. In one particular embodiment, the resonant system operates at 100 MHz. The RF electrode system 370 may have a high frequency power generator (not shown) that may include a frequency oscillator in communication with one or more amplifiers. The RF electrode system 370 creates an alternating electrical potential between the RF electrodes 340, 342 and grounded structures (e.g., pole tops) thereby accelerating the charged particles. The magnetic fields generated by the yoke sections and electromagnetic coils may facilitate in guiding the charged particles.

Also shown in FIG. 3, a plurality of movable mechanical devices may be disposed within the acceleration chamber. For example, a stripping assembly 380 may be mounted to the pole 350 and a diagnostic probe assembly 382 may also be mounted to the pole 350. In addition to the stripping and probe assemblies 380 and 382, embodiments described may include other movable mechanical devices within the acceleration chamber. The movable mechanical devices may be configured to move during operation of the cyclotron and/or when the magnet yoke is sealed. More specifically, the mechanical devices may be configured to repeatedly operate (e.g., move back and forth between different positions) while within a vacuum state and while sustaining a large magnetic flux.

Figure 4:
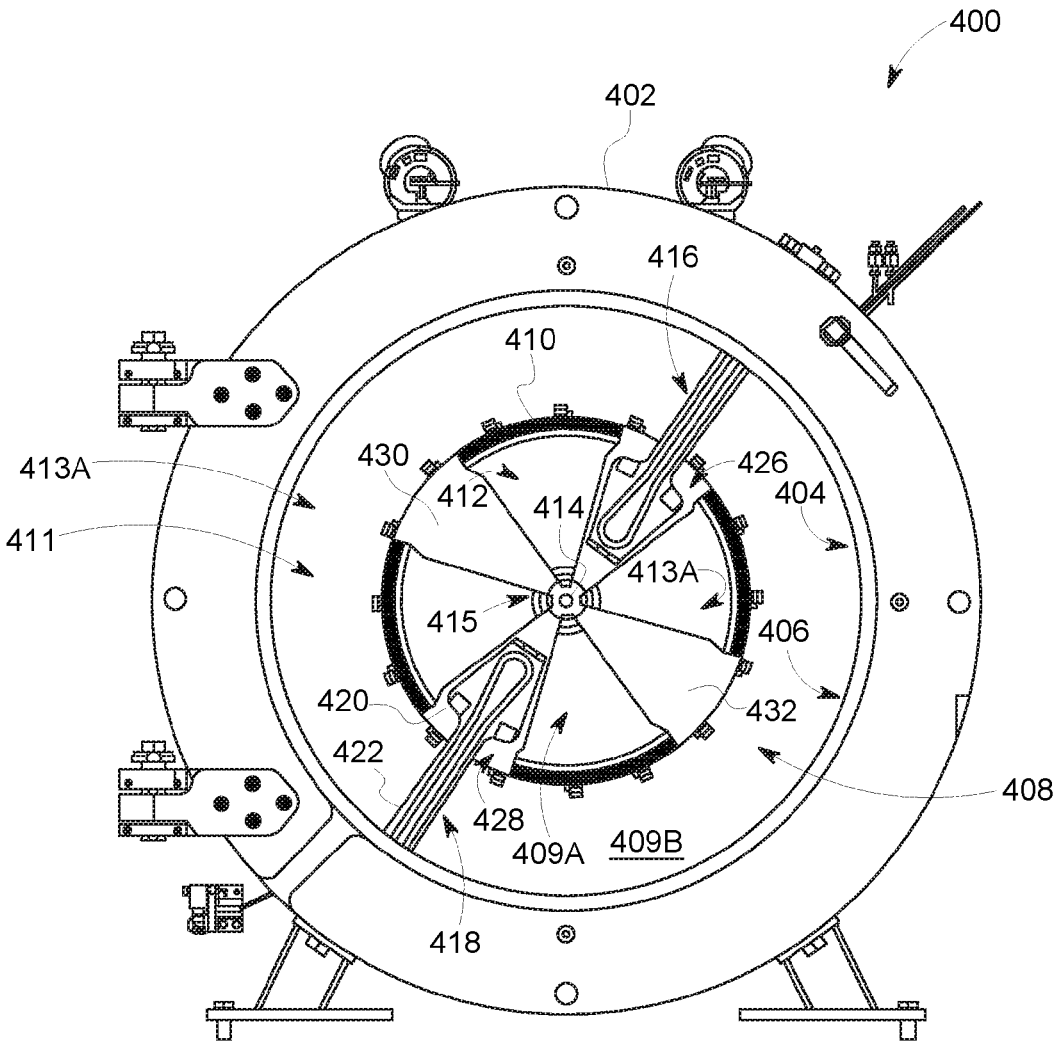
FIG. 4 is a plan view of a yoke section that may be used with a cyclotron formed in accordance with an embodiment.

FIG. 4 is a plan view of a sub-assembly 400 in accordance with an embodiment. The sub-assembly 400 is configured to mate with an opposing yoke section (not shown) to form a magnet yoke, such as the magnet yoke 202 (FIG. 2), and/or a cyclotron, such as the cyclotron 200 (FIG. 2). The sub-assembly 400 may be similar or identical to the yoke section 330 (FIG. 3). As shown, the sub-assembly 400 includes a yoke section 402 having an inner wall 404. The yoke section 402 may comprise, for example, iron. The inner wall 404 has a radially-inward surface 406. When the yoke section 402 is mated with another yoke section, an acceleration chamber is formed therebetween. The acceleration chamber is indicated as 408 in FIG. 4, but it should be understood that only a portion of the acceleration chamber is shown in FIG. 4. The acceleration chamber 408 includes an inner spatial region 409A and an outer spatial region 409B that surrounds the inner spatial region 409A about a central axis 414 of the cyclotron.

The sub-assembly 400 also includes a pole 410 having a pole top 412. The central axis 414 extends through a center of the pole top 412. The central axis 414 may extend through a central region 415 around which a particle beam is directed. An ion source (not shown) may be configured to provide the charged particles within or proximate to the central region 415. The sub-assembly 400 also includes a pair of RF electrodes 416, 418. Each of the RF electrodes 416, 418 includes a hollowed dee 420 and a bridge structure 422. The bridge structures 422 are mounted to the inner wall 404 of the yokes section 402 and extend radially inward toward the central axis 414 from the radially-inward surface 406. The bridge structures 422 extend through the outer spatial region 409B.

The acceleration chamber 408 is defined by a chamber surface 411. The chamber surface 411 may collectively include multiple surfaces of the yoke sections that define the acceleration chamber 408. For example, the chamber surface 411 may include the radially-inward surface 406, an axial surface 413A along the yoke section, and an axial surface 415A along the pole 410. The axial surfaces 413A, 415A face in a direction that is generally along the central axis 414. It should be understood that other surfaces that define the acceleration chamber 408 may be portions or areas of the chamber surface 411.

In FIG. 4, the hollowed dees 420 are positioned adjacent to the pole top 412. More specifically, the hollowed dees 420 of the RF electrodes 416, 418 are positioned within valleys 426, 428, respectively, of the pole top 412. When the cyclotron is fully assembled, the hollowed dees 420 are positioned between the pole top 412 and the pole top of the opposing yoke section. Also shown, the pole top 412 includes valleys 430, 432. Optionally, the valleys 430, 432 may provide room for additional sub-systems.

Figure 5:
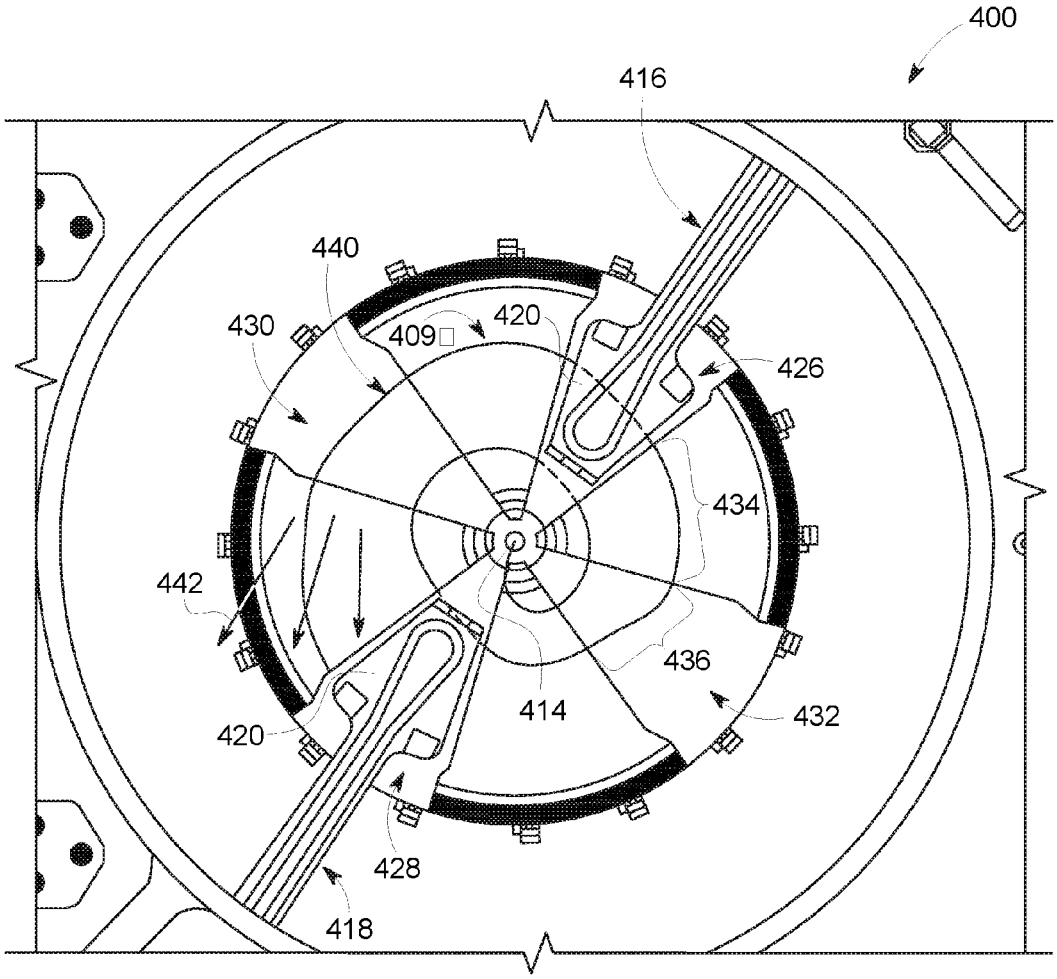
FIG. 5 is an enlarged plan view of the yoke section of FIG. 4 illustrating an orbit of charged particles in accordance with an embodiment.

FIG. 5 is an enlarged plan view of the sub-assembly 400. During operation of the cyclotron, an orbit 440 of the particle beam is created. As the charged particles are introduced into the acceleration chamber 408 near the central region 415, the RF electrodes 416, 418 are electrically controlled to direct the charged particles along the designated orbit 440. The designated orbit 440 is generally parallel to an orbit plane (or mid-plane) 444 (shown in FIG. 6) that divides the inner spatial region 409A between the pole tops. As used herein, the phrase "generally parallel to the orbit plane" includes being positioned at least partially above or below the orbit plane or coinciding with the orbit plane. It should be understood that the orbit 440 shown in FIG. 4 is illustrative only and may have different dimensions or qualities in practice. For example, the orbit 440 may include a different number of wraps or turns than those shown in FIG. 4.

The orbit 440 wraps about the central axis 414 and includes first curved portions 434 and second curved portions 436. The curvature of the orbit 440 is a function of the strength of the magnetic field between the pole tops. The first curved portions 434 of the orbit 440 correspond to regions that have a stronger magnetic field, and the second curved portions 436 of the orbit 440 correspond to regions that have a weaker magnetic field (i.e., compared to the stronger magnetic fields). In the illustrated embodiment, the weaker magnetic fields occur because there is a greater gap between the pole tops within the valleys 426, 428, 430, 432. As such, the stronger magnetic fields cause the first curved portions 434 of the orbit 440 to have sharper or tighter curvatures than the second curved portions 436, which may be more linear. As the charged particles are directed along the orbit 440, the charged particles may collide with other particles (e.g., gas molecules) that transform the charged particles into neutral particles. At this moment, the electrical fields generated by the RF electrodes 416, 418 may no longer control the particles. As such, the trajectory of the neutral particles may be tangent to the point at which the corresponding charged particle and other molecule collided.

During operation of the cyclotron, the neutral particles are essentially sprayed radially outward along a periphery of the acceleration chambers. This is indicated by the rays 442 shown in FIG. 5. It is noted that only a three rays 442 are shown in FIG. 5 to demonstrate examples of trajectories that the neutral particles may take. It should be understood that the neutral particles are sprayed throughout the acceleration chamber in a direction that is generally parallel to the orbit plane.

The neutral particles may collide with surfaces within the acceleration chamber. For example, the neutral particles may propagate into the outer spatial region and collide with the bridge structures of the RF electrodes. When the neutral particles collide with the interior surfaces, secondary gamma radiation is generated and radioisotopes may be created. For example, if the neutral particles collide with copper, the long-lived isotope of Zinc-65 may be generated in addition to the prompt radiation. Prompt radiation may be characterized as radiation that results directly/instantaneously from a nuclear reaction. For example, the prompt radiation may be gamma radiation that results from a proton hitting certain material (e.g., copper). To ameliorate these undesirable events, interception panels may be positioned within the acceleration chamber.

Figure 6:
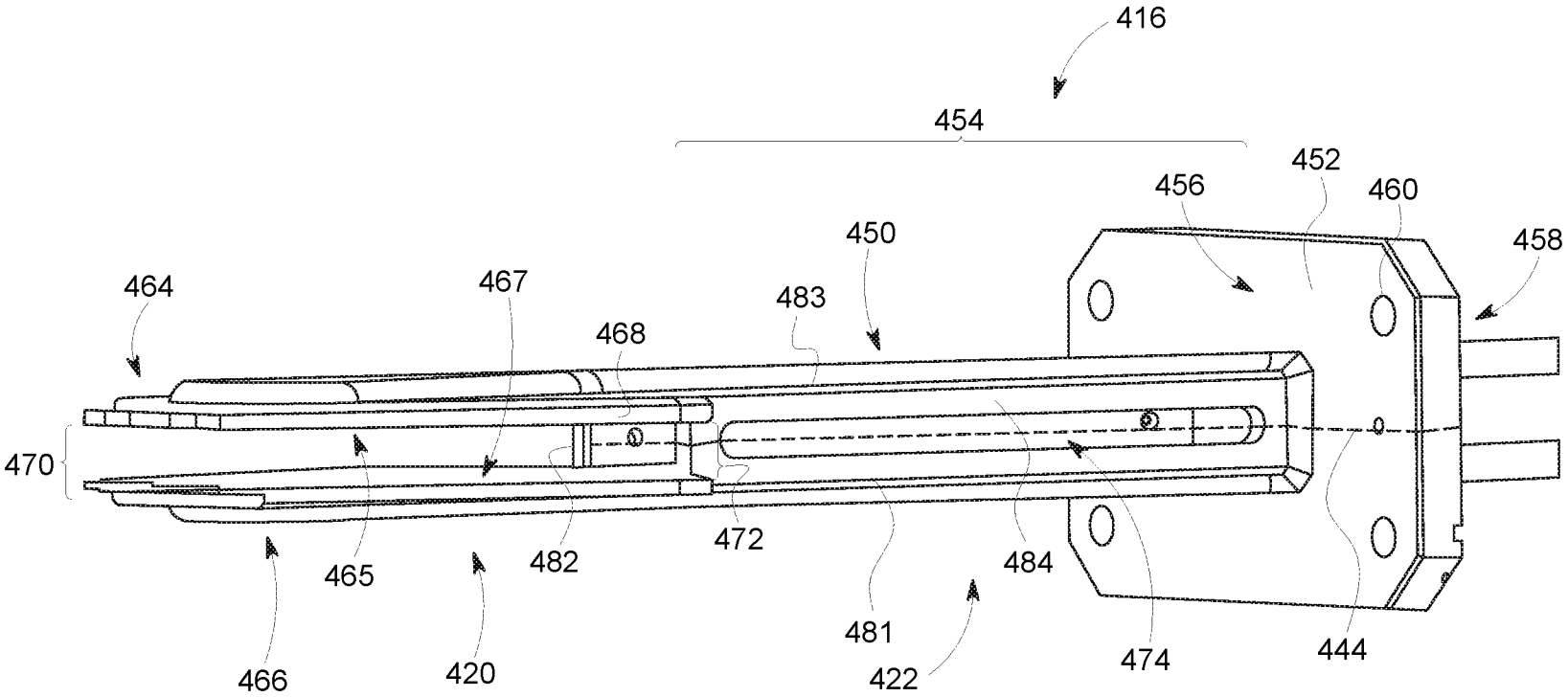
FIG. 6 is a side perspective view of an RF electrode formed in accordance with an embodiment.

FIG. 6 is a side perspective view of the RF electrode 416. The RF electrode 418 (FIG. 4) may be similar or identical to the RF electrode 416. The RF electrode 416 includes the hollowed dee 420 and the bridge structure 422. The bridge structure 422 is configured to couple to the chamber surface 411 (FIG. 4) and hold the hollowed dee 420 at a designated position in the inner spatial region 409A (FIG. 4). In some embodiments, the bridge structure 422 couples to an area of the chamber surface 411 that defines the outer spatial region 409B (FIG. 4), such as the radially-inward surface 406 (FIG. 4) or the axial surface 413A (FIG. 4). At least a portion of the bridge structure 422 is disposed within or proximate to the orbit plane 444. The orbit plane 444 is indicated as a dashed line along surfaces of the RF electrode 416 in FIG. 6.

For example, in the illustrated embodiment, the bridge structure 422 includes an elongated stem 450 and an optional base panel 452. When positioned in the acceleration chamber 408 (FIG. 4), the elongated stem 450 is configured to extend in a radial direction between the base panel 452 (or the radially-inward surface 406) and the hollowed dee 420. The elongated stem 450 may extend radially away from the central region 415 (FIG. 4) and extend away from the hollowed dee 420. At least a portion of the elongated stem 450 is disposed within or proximate to the orbit plane 444 such that neutral particles may collide with surfaces of the elongated stem 450 (or would collide with surfaces if the particle opening did not exist). As shown, the orbit plane 444 intersects the elongated stem 450 along an entire length 454 of the elongated stem 450. A portion of the elongated stem 450 may be located immediately above or immediately below the orbit plane 444 at a position where neutral particles may collide with the elongated stem 450.

The base panel 452 is configured to directly couple to the radially-inward surface 406 (FIG. 4). For example, the base panel 452 has a mating surface 456 and a panel surface 458 that face in opposite directions and a thickness extending therebetween. The base panel 452 may also include thru-holes 460 for receiving fasteners that couple the base panel 452 to another structure. The base panel 452 may be secured directly to the chamber surface 411 or the radially-inward surface 406. In other embodiments, the base panel 452 does not exist within the acceleration chamber 408 and the elongated stem 450 or other portion of the bridge structure 422 may extend through a passage of the magnet yoke.

It is contemplated, however, that the base panel 452 or other portion of the bridge structure 422 may couple to the axial surface 413A (FIG. 4). In such embodiments, the bridge structure 422 or the elongated stem 450 may have a non-linear or non-planar shape. For example, the bridge structure 422 or the elongated stem 450 may be L-shaped in which one leg is disposed within or proximate to the orbit plane 444 and another leg extends in an axial direction and coupes to the axial surface 413A. Accordingly, the bridge structure 422 may have shapes and or dimensions that differ from the shapes and dimensions shown in FIG. 6.

The hollowed dee 420 includes first and second plate sections 464, 466 that include first and second inner surfaces 465, 467, respectively. The first and second plate sections 464, 466 have respective outer edges 468 that define triangular or pie-shaped profiles. For example, the profiles of the first and second plate sections 464, 466 may forms sectors of a circle having arcs that equal between about 30° and about 40° of the circle. The outer edges 468 may each define a point, wherein the points of the first and second plate sections 464, 466 may collectively represent a distal end 470 of the RF electrode 416. In other embodiments, the profiles of the first and second plate sections 464, 466 may be semi-circular (e.g., half circles).

As shown, the first and second plate sections 464, 466 oppose each other and define a gap 472 therebetween. The gap 472 is sized and shaped to permit the beam of the charged particles to be directed therethrough along the orbit 440 (FIG. 5). Also shown in FIG. 6, the elongated stem 450 includes a plurality of side walls 481-484 that define an interior cavity 474 of the elongated stem 450, or the bridge structure 422 more generally. In the illustrated embodiment, the interior cavity 474 is completely surrounded by the side walls 481-484. In other embodiments, the interior cavity 474 may be open-sided channel. For example, one or more portions of the side wall 481 and/or of the side wall 483 may be removed or the entire side walls 481, 483 may be removed.

Figure 7:
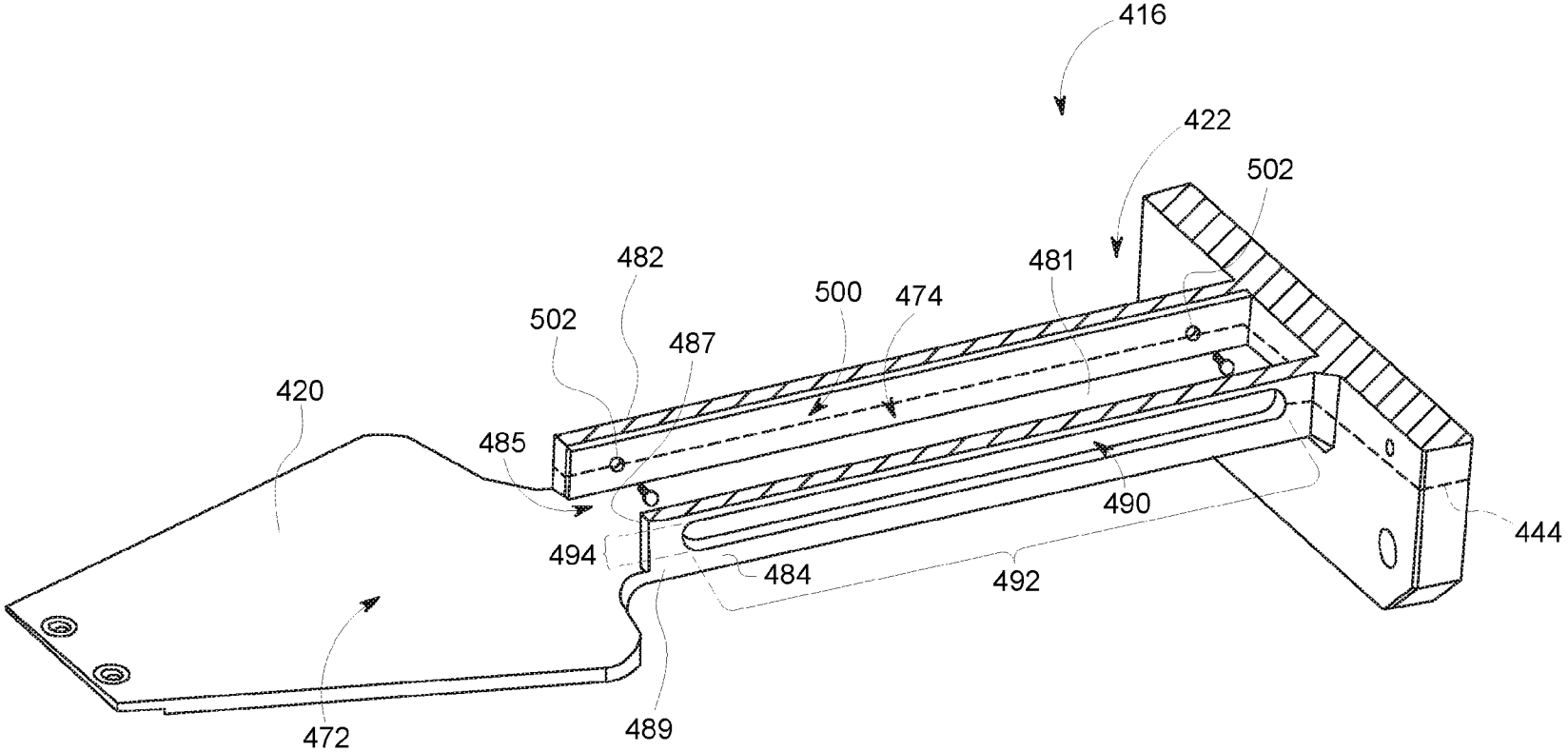
FIG. 7 is a sectional view of the RF electrode illustrating an interior cavity and interception panel in greater detail.

FIG. 7 is a sectional view of the RF electrode 416. The side walls 482, 484 oppose each other with the interior cavity 474 therebetween, and the side walls 481, 483 (FIG. 6) oppose each other with the interior cavity 474 therebetween. The interior cavity 474 has a cavity opening 485 that opens to the gap 472. Only the plate section 466 is shown in FIG. 7. In the illustrated embodiment, the orbit plane 444 generally intersects the side walls 482, 484 and may extend parallel to and between the side walls 481, 483. The orbit plane 444 may also extend through the opening 485.

As shown, the side wall 484 has a single elongated particle opening 490 therethrough that extends generally parallel to the orbit plane 444. The particle opening 490 is positioned to coincide with or be proximate to the orbit plane 444. As shown, the particle opening 490 has a first dimension 492 measured radially with respect to the central axis 414 (or measured parallel to the orbit plane 444) and a second dimension 494 that is measured perpendicular to the orbit plane 444 (or parallel to the central axis 414 (FIG. 4)). The first dimension 492 may be at least two times (2×), at least three times (3×), at least five times (5×), or at least ten times (10×) the second dimension 494. The first dimension 492 may be at least 50%, at least 60%, at least 70%, or at least 80% of the length 454 (FIG. 6) of the elongated stem 450. In some embodiments, the side wall 484 has a cavity edge 487 that defines the cavity opening 485. The side wall 484 may have a support section 489 that includes the cavity edge 487 and defines an end of the particle opening 490. The support section 489 may have a relatively small dimension measured parallel to the orbit plane 444. For example, the support section 489 may be one, two, or three centimeters (cm) in some embodiments.

However, it should be noted that although the side wall 484 includes only one elongated particle opening 490 in FIG. 7, other embodiments may include a plurality of particle openings having various dimensions. The particle opening 490 is located to receive the neutral particles that project from the orbit 440 of the particle beam. The trajectories of the neutral particles may be along the orbit plane (e.g., generally parallel to the orbit plane). In addition to the particle opening 490, the cavity opening 485 may receive neutral particles therethrough.

Embodiments set forth herein include interception panels that are configured to receive the neutral particles so that the neutral particles collide with the interception panels instead of other surfaces within the acceleration chamber. In some embodiments, the interception panel are positioned within a volume of space that is substantially free of electromagnetic fields, compared to the surrounding volume of space in the acceleration chamber. For example, the interception panels may be disposed within the interior cavity 474 of the bridge structure 422, which may function similar to a Faraday cage that surrounds the interception panel 500 and substantially excludes electromagnetic fields. Electromagnetic fields may induce a current that generates heat through electromagnetic losses. This heat may negatively affect the performance of the cyclotron. However, it should be understood that the interception panels are not required to be positioned within the interior cavity 474 and may have different positions in other embodiments.

In the illustrated embodiment, the RF electrode 416 includes an interception panel 500 that is positioned within the interior cavity 474. More specifically, the interception panel 500 faces the particle opening 490 with the interior cavity 474 extending between the particle opening 490 (or the side wall 484) and the interception panel 500. The interception panel 500 is positioned so that neutral particles propagating through the particle opening 490 will collide with the interception panel 500. The interception panel 500 is also positioned so that neutral particles propagating through the cavity opening 485 will collide with the interception panel 500. In FIG. 7, the interception panel 500 is a single continuous structure. In other embodiments, the interception panel 500 may be multiple discrete structures or multiple interception panels 500 may be used.

As shown, the interception panel 500 is secured directly to the bridge structure 422. In particular, the interception panel 500 is secured directly to the side wall 482. To this end, the side wall 482 and the interception panel 500 may be configured to permit securing the interception panel 500 thereto. For example, the interception panel 500 and the side wall 482 may include thru-holes 502 that are configured to receive hardware (e.g., screws). In some embodiments, the interception panel 500 may be removed and replaced with another interception panel 500.

However, it is contemplated that the interception panel 500 may have other positions within the interior cavity 474. For example, the interception panel 500 may be secured to an interior side of the side wall 484 such that the neutral particles move through the particle opening 490 and immediately collide with the interception panel 500. Optionally, a portion of the interception panel 500 may extend into and, optionally, through the particle opening 490. In another configuration, the interception panel 500 may be spaced apart from each of the side walls 482, 484. For example, the interception panel 500 may be positioned about half-way between the side wall 482 and the side wall 484.

As shown, the interception panel 500 has a planar, rectangular structure that extends parallel to the side walls 482, 484. However, the interception panel 500 may have other shapes and other orientations within the interior cavity 474 in alternative embodiments. The dimension of the interception panel 500 may be configured to increase the likelihood that neutral particles will collide with the interception panel 500 instead of the conductive material of the bridge structure 422.

Yet in other embodiments, the interception panel 500 may be positioned outside of the RF electrode 416. For example, the side wall 482 may also include a particle opening (not shown). The neutral particles may propagate through the particle opening 490 and the particle opening of the side wall 482 such that the neutral particles travel entirely through the bridge structure 422. In such embodiments, the interception panel 500 may be outside of the RF electrode 416 and positioned and shaped to intercept the neutral particles.

The bridge structure 422 and the hollowed dee 420 comprise a conductive material, such as copper. The interception panel 500 comprises a blocking material that has a different composition than the conductive material. The blocking material and the conductive material may both be capable of generating respective radioisotopes when the neutral particles are incident thereon. For example, Zn-65 isotopes may be generated when neutral hydrogen particles are incident on copper. The blocking material, however, may be a material that generates radioisotopes having shorter half-lives than the radioisotopes that are generated by the conductive material if the charged particles are incident thereon. By way of example, the blocking material of the interception panel 500 may include at least one of graphite (e.g., electro-graphite) or tungsten. In some embodiments, the composition of the interception panel 500 consists essentially of graphite or tungsten or is pure graphite or pure tungsten.

As used herein, a "long-lived radioisotope" is a radioisotope that has a half-life that is at least one day. As used herein, a "short-lived radioisotope" is a radioisotope that has a half-life that is at most 10 hours. In more particular embodiments, a long-lived radioisotope may have a half-life that is greater than 18 hours or greater than 10 hours.

It should be noted that the particular arrangement of components (e.g., the number, types, placement, or the like) of the illustrated embodiments may be modified in various alternative embodiments. In various embodiments, different numbers of a given element may be employed, a different type or types of a given element may be employed, a given element may be added, or a given element may be omitted.

Figure 8:
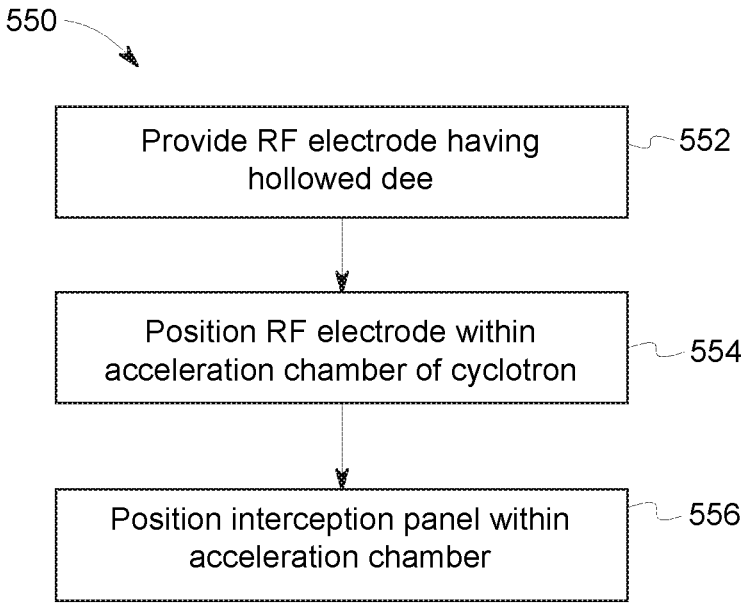
FIG. 8 is a flow chart of a method in accordance with an embodiment.

FIG. 8 is a flow chart of a method 550 in accordance with an embodiment. The method 550 may be, for example, a method of manufacturing a cyclotron, assembling a cyclotron, or maintaining a cyclotron. For example, the method 550 may be performed when replacing and/or cleaning elements within an acceleration chamber. The method 550 may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

The method 550 includes providing, at 552, an RF electrode that has a hollowed dee having first and second surfaces that oppose each other and define a gap therebetween. The RF electrode may be similar to, for example, the RF electrode 416 (FIG. 4). The RF electrode also includes a bridge structure that is coupled to and extends away from the hollowed dee. The bridge structure includes a side wall that defines an interior cavity of the bridge structure. The side wall has a particle opening therethrough. In particular embodiments, the bridge structure includes an elongated stem having a length that is greater than a width or height of the elongates stem.

The method 550 also includes positioning, at 554, the RF electrode within an acceleration chamber of a cyclotron. The cyclotron is configured to direct charged particles along an orbit plane within the acceleration chamber. The RF electrode may be positioned such that the orbit plane extends between the first and second surfaces and extends through or proximate to the particle opening of the side wall. The particle opening is configured to receive neutral particles that project along the orbit plane during operation of the cyclotron.

The method 550 may also include positioning, at 556, an interception panel within the acceleration chamber to receive the neutral particles that project through the particle opening along the orbit plane. In some embodiments, the positioning at 554 and the positioning at 556 occur simultaneously. For example, the RF electrode may be fully assembled with the interception panel attached thereto. Thus, when the RF electrode is operably positioned within the acceleration chamber, the interception panel is also positioned. As described herein, the interception panel may comprise a blocking material.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand alone programs, may be incorporated as subroutines in an operating system, may be functions in an installed software package, or the like. The various embodiments are not limited to the arrangements and instrumentality shown in the drawings.

What is claimed is:

1. A radio-frequency (RF) electrode for a cyclotron, the RF electrode comprising:

a hollowed dee comprising first and second plate sections that oppose each other and define a gap therebetween, the hollowed dee configured to be disposed within an acceleration chamber of a cyclotron in which a beam of charged particles is directed through the gap and along an orbit plane of the cyclotron, the orbit plane extending through the gap and being essentially parallel to the first and second plate sections; and a bridge structure supporting and extending away from the hollowed dee, the bridge structure including a side wall having a particle opening therethrough that coincides with or is proximate to the orbit plane such that the particle opening receives neutral particles that are generated from the beam of the charged particles.

2. The RF electrode of claim 1, wherein the side wall is a first side wall and the bridge structure includes a second side wall that opposes the first side wall with an interior cavity of the bridge structure therebetween, the second side wall facing the particle opening of the first side wall, wherein the particle opening is an elongated particle opening in which a length of the particle opening measured parallel to the orbit plane is at least five times (5×) a height of the particle opening measured perpendicular to the orbit plane.

3. The RF electrode of claim 1, further comprising an interception panel that is configured to be coupled to the bridge structure and positioned to receive the neutral particles that project through the particle opening along the orbit plane.

4. The RF electrode of claim 3, wherein the bridge structure is configured to substantially isolate the interception panel from electromagnetic fields in the acceleration chamber.

5. The RF electrode of claim 3, wherein the bridge structure comprises a conductive material and the interception panel comprises a blocking material;

wherein the blocking material and the conductive material are capable of generating respective radioisotopes when neutral hydrogen particles are incident thereon, the blocking material being configured such that the radioisotopes of the blocking material have shorter half-lives than the radioisotopes of the conductive material; and wherein the blocking material and the conductive material are capable of generating prompt radiation when the neutral hydrogen particles are incident thereon, the blocking material being configured such that the prompt radiation from the blocking material is less than the prompt radiation from the conductive material.

6. The RF electrode of claim 3, wherein the side wall defines an interior cavity of the bridge structure, the interception panel being disposed within the interior cavity.

7. The RF electrode of claim 4, wherein the interception panel is secured directly to the bridge structure within the interior cavity.

8. The RF electrode of claim 3, wherein the interception panel includes at least one of graphite or tungsten.

9. The RF electrode of claim 1, wherein the bridge structure includes an elongated stem, the elongated stem extending away from the hollowed dee, the elongated stem including the particle opening, the particle opening having a first dimension and a second dimension, the first dimension extending parallel to the orbit plane and the second dimension extending perpendicular to the orbit plane, the first dimension being at least three times (3×) the second dimension.

10. A cyclotron comprising:

an electrical field system and a magnetic field system configured to direct a beam of charged particles along an orbit plane within an acceleration chamber, wherein the magnetic field system includes a pair of pole tops positioned in the acceleration chamber that oppose each other, the orbit plane extending between and generally parallel to the pole tops, the electrical field system including a plurality of RF electrodes having hollowed dees positioned between the pole tops;

wherein at least one of the RF electrodes includes a bridge structure that is coupled to and extends away from the corresponding hollowed dee, the bridge structure including a side wall having a particle opening therethrough that coincides with or is proximate to the orbit plane, the particle opening being positioned to receive neutral particles generated from the beam of the charged particles within the acceleration chamber, wherein the cyclotron also includes an interception panel that is positioned relative to the particle opening to receive the neutral particles.

11. The cyclotron of claim 10, wherein the acceleration chamber includes an inner spatial region between the pole tops and an outer spatial region that surrounds the inner spatial region, the bridge structure being disposed within the outer spatial region.

12. The cyclotron of claim 10, wherein the side wall is a first side wall and the bridge structure includes a second side wall that opposes the first side wall with an interior cavity of the bridge structure therebetween, the interception panel being positioned within the interior cavity.

13. The cyclotron of claim 12, wherein the interception panel is secured directly to the bridge structure within the interior cavity.

14. The cyclotron of claim 12, wherein the bridge structure is configured to substantially isolate the interception panel from electromagnetic fields in the acceleration chamber.

15. The cyclotron of claim 10, wherein the bridge structure comprises a conductive material and the interception panel comprises a blocking material;

wherein the blocking material and the conductive material are capable of generating respective radioisotopes when neutral hydrogen particles are incident thereon, the blocking material being configured such that the radioisotopes of the blocking material have shorter half-lives than the radioisotopes of the conductive material; and wherein the blocking material and the conductive material are capable of generating prompt radiation when the neutral hydrogen particles are incident thereon, the blocking material being configured such that the prompt radiation from the blocking material is less than the prompt radiation from the conductive material.

16. The cyclotron of claim 10, wherein the particle opening has a first dimension and a second dimension, the first dimension extending parallel to the orbit plane and the second dimension extending perpendicular to the orbit plane, the first dimension being at least three times (3×) the second dimension.

17. A method comprising:

providing an RF electrode that includes a hollowed dee having first and second plate sections that oppose each other and define a gap therebetween, the RF electrode also including a bridge structure that is coupled to and extends away from the hollowed dee, the bridge structure including a side wall having a particle opening therethrough;

positioning the RF electrode within an acceleration chamber of a cyclotron, the cyclotron configured to direct a beam of charged particles along an orbit plane within the acceleration chamber, the RF electrode being positioned such that the orbit plane extends between the first and second plate sections and extends through or proximate to the particle opening of the side wall, the particle opening positioned to receive neutral particles that are generated from the beam of the charged particles during operation of the cyclotron; and positioning an interception panel within the acceleration chamber to receive the neutral particles that project through the particle opening along the orbit plane.

18. The method of claim 17, wherein positioning the interception panel includes positioning the interception panel within an interior cavity of the bridge structure, the side wall defining the interior cavity.

19. The method of claim 18, wherein positioning the interception panel includes securing the interception panel directly to the bridge structure within the interior cavity.

20. The method of claim 17, wherein the bridge structure comprises a conductive material and the interception panel comprises a blocking material;

wherein the blocking material and the conductive material are capable of generating respective radioisotopes when neutral hydrogen particles are incident thereon, the blocking material being configured such that the radioisotopes of the blocking material have shorter half-lives than the radioisotopes of the conductive material; and wherein the blocking material and the conductive material are capable of generating prompt radiation when the neutral hydrogen particles are incident thereon, the blocking material being configured such that the prompt radiation from the blocking material is less than the prompt radiation from the conductive material.

* * * * *